US011472655B2

(12) United States Patent
Huang et al.

(10) Patent No.: US 11,472,655 B2
(45) Date of Patent: Oct. 18, 2022

(54) RETAINERS WITH MOVABLE PINCH ARMS

(71) Applicant: Hewlett-Packard Development Company, L.P., Spring, TX (US)

(72) Inventors: Xiaoxi Huang, Singapore (SG); De-Ming Xu, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 726 days.

(21) Appl. No.: 16/341,339

(22) PCT Filed: Feb. 3, 2017

(86) PCT No.: PCT/US2017/016489
§ 371 (c)(1),
(2) Date: Apr. 11, 2019

(87) PCT Pub. No.: WO2018/144013
PCT Pub. Date: Aug. 9, 2018

(65) Prior Publication Data
US 2019/0241390 A1 Aug. 8, 2019

(51) Int. Cl.
*B65H 20/02* (2006.01)
*B41J 15/04* (2006.01)
(Continued)

(52) U.S. Cl.
CPC ..... *B65H 20/02* (2013.01); *B41J 15/042* (2013.01); *B41J 15/046* (2013.01);
(Continued)

(58) Field of Classification Search
CPC ..... B65H 20/02
(Continued)

(56) References Cited

U.S. PATENT DOCUMENTS 3,567,215 A 3/1971 Gates
4,598,298 A 7/1986 Groenke et al.
(Continued)

FOREIGN PATENT DOCUMENTS

EP 0925947 6/1999
JP 58115322 9/1983
(Continued)

OTHER PUBLICATIONS

HP Pincharm lift mechanism—Includes cam (a long bar), cam bushings, pinch arm lever, pinch arm lever bushing. DEC Trader, Newbury Park, CA, USA, accessed online Nov. 25, 2016 <http://www.dectrader.com/C777060015NewHPPincharmliftmechanismIncludescamalongbarcambushingspincharmleverpincharmleverbushing>.

(Continued)

*Primary Examiner* — Jill E Culler
(74) *Attorney, Agent, or Firm* — HP Inc. Patent Department

(57) ABSTRACT

In an example, a retainer may include a transition arm having a lift tab. The retainer may further include a pinch arm pivotably or movably engaged with the transition arm. The pinch arm may be movable between an engaged position and a stowed position, and may have a pinching member disposed on a pinching end of the pinch arm. Further, the transition arm may move the pinch arm form the engaged position to the stowed position upon the lift tab being moved about a retainer pivot point.

15 Claims, 7 Drawing Sheets

(51) Int. Cl.
*B65H 16/00* (2006.01)
*B65H 16/02* (2006.01)

(52) U.S. Cl.
CPC ..... *B65H 16/005* (2013.01); *B65H 16/02* (2013.01); *B65H 2402/441* (2013.01); *B65H 2403/51* (2013.01)

(58) Field of Classification Search
USPC ..... 400/613
See application file for complete search history.

(56) References Cited

U.S. PATENT DOCUMENTS 5,816,722 A * 10/1998 Fujiwara ..... B41J 11/00 400/605
6,374,730 B1 * 4/2002 Kuratani ..... B41L 13/04 101/115
7,114,867 B2 10/2006 Ohashi et al.
8,540,243 B2 9/2013 Tanaka et al.
2002/0014174 A1 2/2002 Rombault et al.
2003/0172823 A1 * 9/2003 Benson ..... B65H 3/10 101/233
2006/0285909 A1 12/2006 Peck et al.
2008/0136080 A1 6/2008 Won
2011/0169213 A1 * 7/2011 Iwata ..... B65H 3/0607 271/162

FOREIGN PATENT DOCUMENTS

JP 2001302013 10/2001
JP 2015134655 7/2015

OTHER PUBLICATIONS

Search report and written opinion for priority application PCT/US2017/016489 dated Feb. 3, 2017, 7 pp.

* cited by examiner

RETAINERS WITH MOVABLE PINCH ARMS

BACKGROUND

Devices such as electronic devices may perform functions or operations on or with media. Such devices may include imaging devices. Imaging devices may perform imaging operations on or with media, which may sometimes be disposed on a media roll. Media rolls may be loaded into such imaging devices and media from the media roll may be rotatably fed into the imaging device from the media roll. Media may also be loaded into imaging devices in the form of a stack or ream of individual media sheets, and may be fed through the imaging device in a sheet-by-sheet manner.

DETAILED DESCRIPTION

Figure 1A:
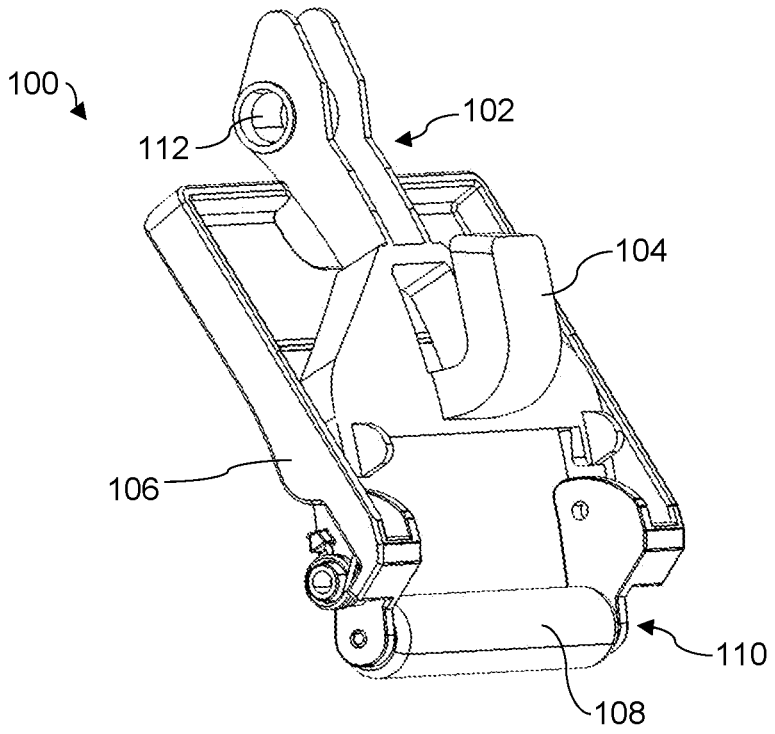
FIG. 1A is a perspective view of an example retainer.

Devices such as electronic devices may perform functions or operations on or with media. Such devices may include imaging devices. Imaging devices may perform imaging operations on or with media, sometimes referred to as print media or a print medium, which may sometimes be disposed on a media roll and referred to as a print media roll. Imaging operations may include printing, scanning, copying, or other operations involving media. Media rolls may be loaded into imaging devices, or a media compartment thereof, and media from the media roll may be fed into the imaging device from the media roll. The media may be fed from the media roll in a continuous sheet, or may be cut into separate sheets and fed through the imaging device. In some situations, media may also be loaded into imaging devices in the form of a stack or ream of individual media sheets, and may be fed through the imaging device in a sheet-by-sheet manner.

In some situations, a media roll may be loaded into a media compartment of an imaging device, and a movable media door may enclose the media compartment. The imaging device may then enable the roll of media, or a spindle thereof, to rotate, thereby rotatably feeding the media from the media roll through the imaging device, and/or through a print zone or other operation zone therein. In such a situation, the media may be susceptible to misalignment or misfeeding as the media comes off the rotating media roll and is fed into internal components of the imaging device. As such, the media door may be large enough, in some imaging devices, to have a fixed pinch mechanism with pinch rollers disposed on an inside portion thereof. Such a pinch mechanism may press against the media or the media roll when the media door is closed so as to avoid misalignment or misfeeding of the media as it is fed from the media roll through the imaging device. Such a media door may be large enough to completely remove the fixed pinch mechanism, or pinch rollers thereof, from contact with the media roll upon the media door being opened, thereby allowing the media roll to be removed or replaced without interference from the pinch mechanism and/or pinch rollers thereof.

In some situations, imaging devices may have a media door that is too small or compact to include or incorporate such a fixed pinch mechanism on an inside portion of the media door. As such, it may be desirable to have a movable retainer disposed within the media door that may transition between a compact stowed position and an engaged position as the media door is opened and closed for the removal and/or insertion of a media roll. Such a movable retainer may be employed in an imaging device that may have a limited amount of volume or space between the media door and the media roll when the media door is closed. Thus, even in imaging devices having a compact footprint, or imaging devices having a media door that may have a small size to avoid interference with other portions of the imaging device, such a movable retainer may enable the media to be accurately and correctly fed from a media roll through the imaging device.

Implementations of the present disclosure provide retainers with pinch arms that may press against media within an imaging device to ensure the media is fed accurately and correctly through the imaging device. Further, retainers with pinch arms disclosed herein may be movable and thus may be employed in imaging devices that may have a media door with a relatively small or compact interior volume or space as compared to larger imaging devices employing traditional, fixed pinch mechanisms.

Figure 1B:
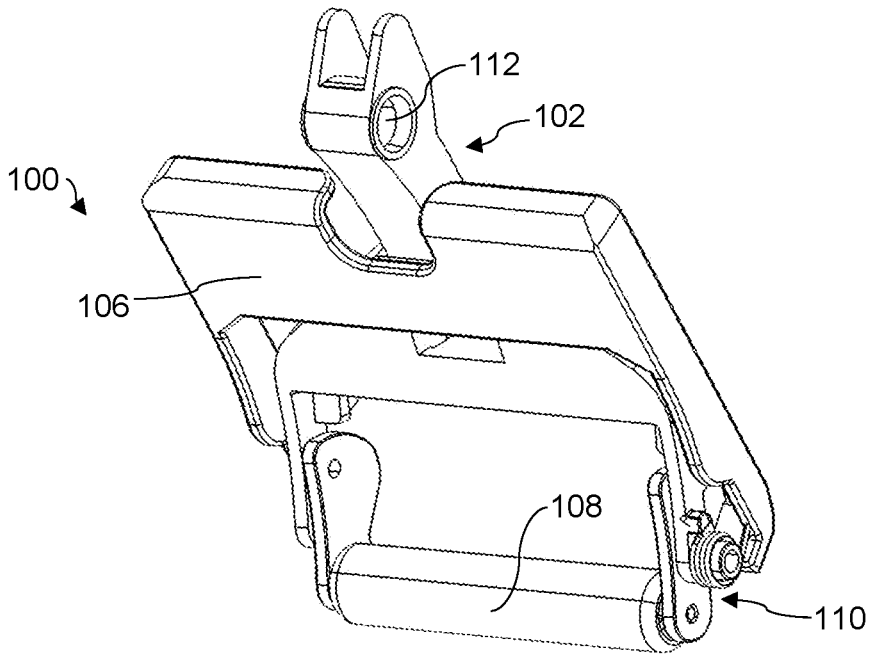
FIG. 1B is a perspective view of an example retainer.

Referring now to FIGS. 1A-1B, perspective views of an example retainer 100 is illustrated. Retainer 100 may include a transition arm 102 having a lift tab 104. Retainer 100 may further include a pinch arm 106 pivotably or movably engaged with the transition arm 102. The pinch arm 106 may be movable between an engaged position and a stowed position, and may have a pinching member 108 disposed on a pinching end 110 of the pinch arm 106. Further, the transition arm 102 may move the pinch arm 106 from the engaged position to the stowed position upon the lift tab 104 being moved about a retainer pivot point 112.

Figure 2A:
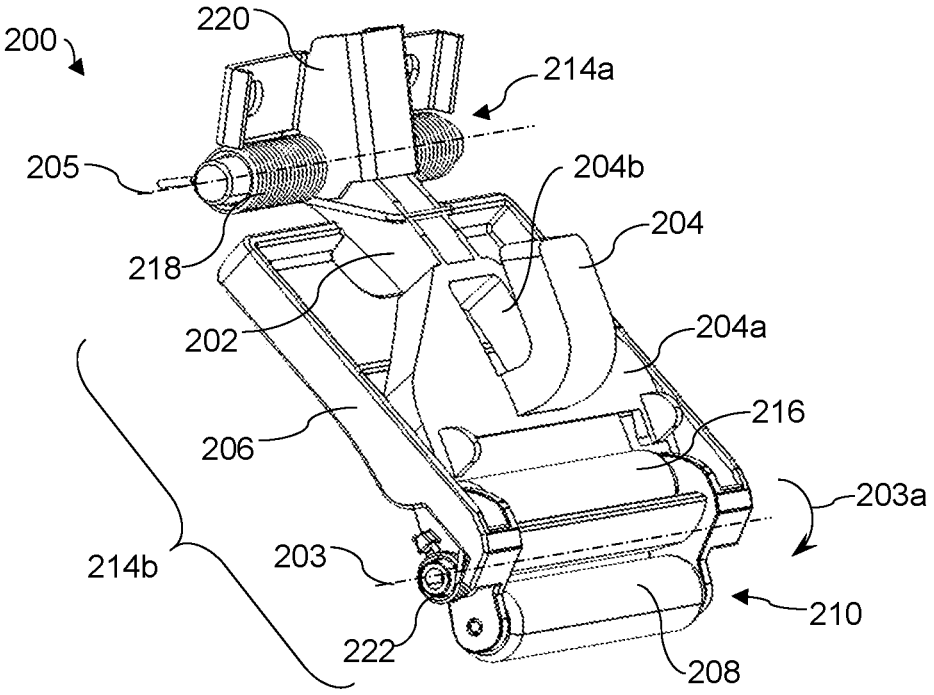
FIG. 2A is a perspective view of an example retainer.
Figure 2B:
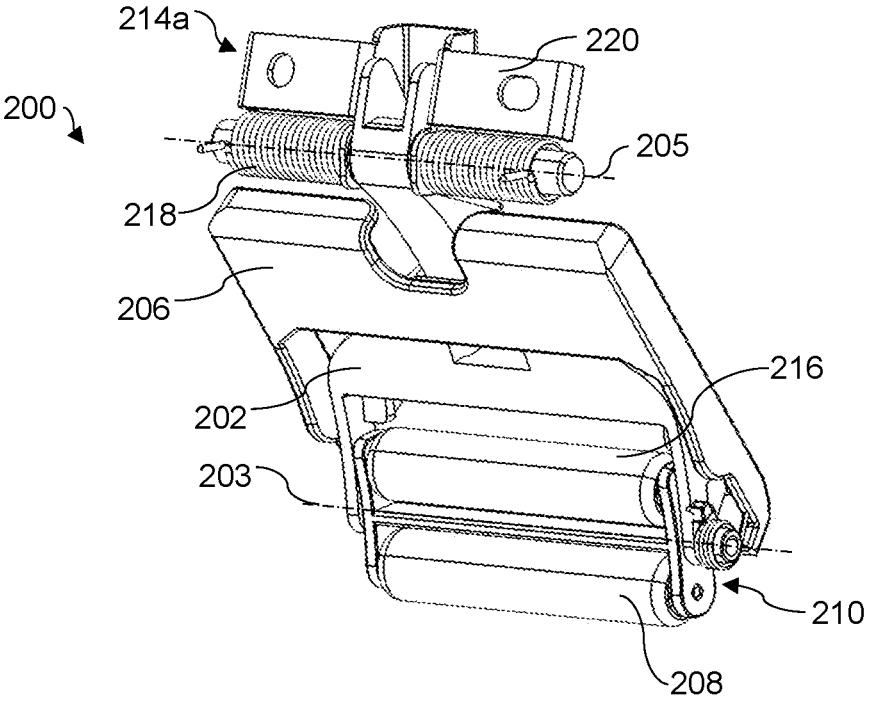
FIG. 2B is a perspective view of an example retainer.

Referring now to FIGS. 2A-2B, perspective views of an example retainer 200 is illustrated. Example retainer 200 may be similar to example retainer 100. Further, the similarly-named elements of example retainer 200 may be similar in function and/or structure to the elements of example retainer 100, as they are described above. The retainer 200 may include a fixed portion 214*a*, and a movable portion 214*b* pivotably engaged with the fixed portion 214*a*. In some implementations, the movable portion may include a transition arm 202 and a pinch arm 206. The transition arm 202 and the pinch arm 206 may be movable or pivotable relative to the fixed portion 214*a* about a retainer pivot point, which may have a pivot axis 205.

The transition arm 202 may be a rigid or semi-rigid member that may enable the movement of the pinch arm 206 about the retainer pivot point. As such, the transition arm 202 may have a first end that is engaged with or movably attached to the fixed portion 214, and a second end that is engaged with or movably attached to the pinch arm 206. Additionally, the transition arm 202 may include a lift tab 204. The lift tab 204 may be a unitary portion of the transition arm 202, or may be a separate element that is assembled on to, or fixed to the transition arm 202. The lift tab 204 may be a protrusion that extends out from a top surface 204*a* of the transition arm 202, and, further, extends over the transition arm 202 to define a lift cavity 204*b* in between the lift tab 204 and the transition arm 202. In some implementations, the lift tab 204 may include a hook-like geometry, or another geometry suitable for defining the lift cavity 204*b*.

The pinch arm 206 may be a rigid or semi-rigid member that is movably or pivotably engaged with the second end of the transition arm 202. The pinch arm 206 may be movably engaged with the transition arm 202 about a pinch axis 203, in some implementations. The pinch arm 206 may have a pinching end 210, which may be disposed adjacent to or otherwise near the second end of the transition arm 202, and/or the pinch axis 203. The pinch arm 206 may further have a pinching member 208 disposed at the pinching end 210. The pinching member 208 may have a suitable structure for pressing against and applying pressure to media, while allowing the media to slide across or against the pinching member 208. In some implementations, the pinching member 208 may have an elongate structure such as a bar or beam, and may extend along a width of the pinch arm 206, or a portion thereof. In further implementations, the pinching member 208 may be or may include a roller 208 that may be rotatable relative to the pinch arm 206. The roller 208 may include a tubular elongate structure, and may extend in a direction substantially parallel to the pinch axis 203. In yet further implementations, the pinching member 208 may include a second roller 216, which may be similar in structure and/or function to the first roller 208, and which may be rotatable relative to the first roller 208 and the pinch arm 206. In some implementations, the first roller 208 and the second roller 216 may be disposed on opposing sides of the pinch axis 203. For example, in some implementations, the first roller 208 may be disposed on an outboard side of the pinch axis 203, and the second roller 216 may be disposed on an inboard side of the pinch axis 203, as illustrated in FIGS. 2A-2B.

In some implementations, the retainer 200 may further include a pinch bias member 222. The pinch bias member 222 may be a resilient component and may be elastically deformable. In other words, the pinch bias member 222 may be capable of returning to its starting shape after undergoing a deformation. In some implementations, the pinch bias member 222 may exert a reactive force in response to being deformed, with such a reactive force being proportional to the degree of deformation. In some implementations, the pinch bias member 222 may be a spring or a torsion spring. In other implementations, the pinch bias member 222 may be another type of spring, such as a compression spring, an extension spring, or a leaf spring. In further implementations, the pinch bias member 222 may be a torsion spring and may be disposed about the pinch axis 203. The pinch bias member 222 may be engaged with the transition arm 202 and the pinch arm 206 such that the pinch bias member 222 urges the pinch arm 206 about the pinch axis 203 in a direction towards the transition arm 202. Such a direction may be represented by arrow 203*a* in FIG. 2A. The pinch bias member 222 may, therefore, urge the pinch arm 206 to mate to or nest with the transition arm 202 when the pinch member 208 is not contacting media. Such a mating or nesting may cause the transition arm 202 and pinch arm 206 to minimize their profile or volume of space that they occupy.

The fixed portion 214*a* may include a mounting bracket 220. The moving portion 214*b* may be movably or pivotably engaged with the mounting bracket 220 about the pivot axis 205. In some implementations, the mounting bracket 220 may be a rigid or semi-rigid structure or member that may attach the retainer 200 to another component, for example, an imaging device or another type of electronic device, or a media door thereof. In some implementations, the mounting bracket 220 may be constructed of bent sheet metal. In other implementations, the mounting bracket 220 may be formed of another type of material. In yet further implementations, the mounting bracket 220 may be a unitary part of the other component to which the retainer 200 may be attached. In other words, the retainer 200 may movably or pivotably attach to the other component directly, without the use of a separate bracket.

In some implementations, the retainer 200, or the fixed portion 214*a* thereof, may include a pivot bias member 218. The pivot bias member 218 may be a resilient component similar to the pinch bias member 222, in some implementations. In further implementations, the pivot bias member 218 may be a torsion spring disposed about the pivot axis 205 and engaged with the mounting bracket 220 and the transition arm 202. As such, in some implementations, the pivot bias member 218 may urge the transition arm 202, and thus the entire movable portion 214*b*, in a direction about the pivot axis 205.

Figure 3A:
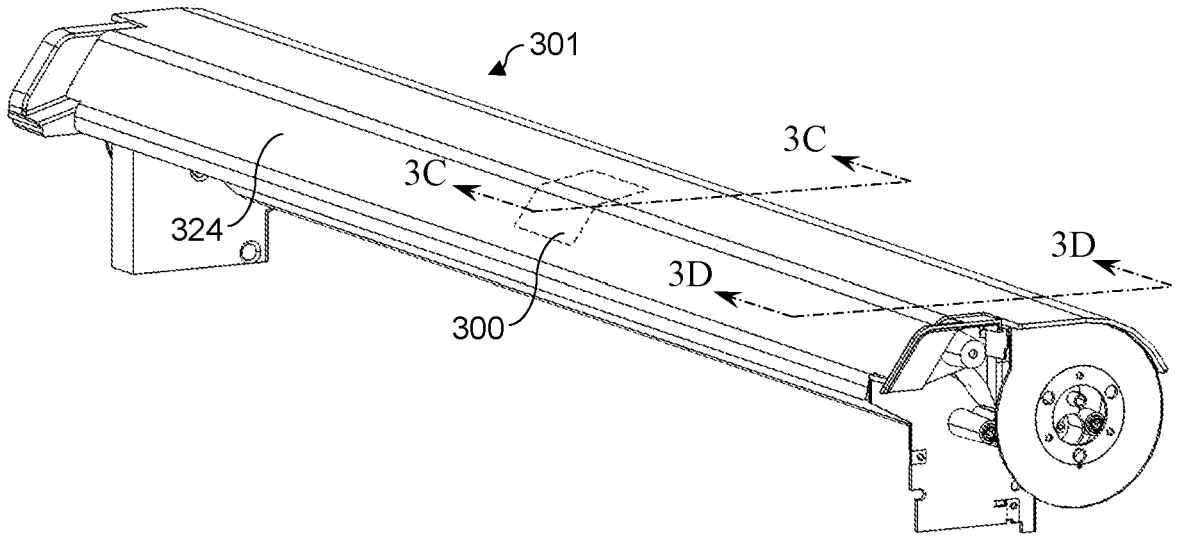
FIG. 3A is a perspective view of an electronic device having an example retainer.
Figure 3B:
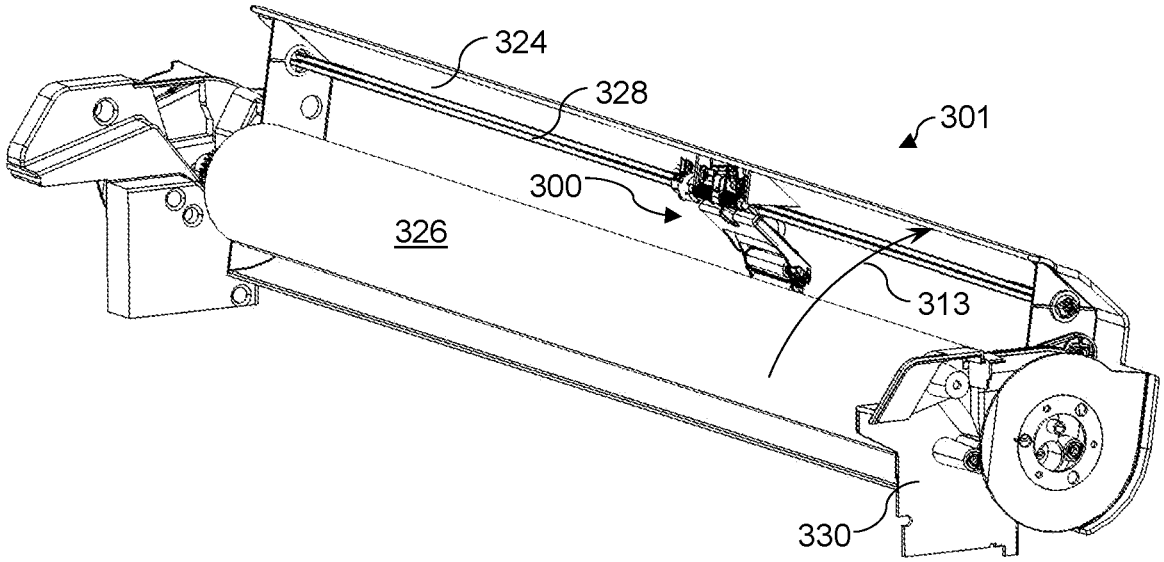
FIG. 3B is a perspective view of an electronic device having an example retainer.

Referring now to FIG. 3A, a perspective view of an electronic device 301 having an example retainer 300 is illustrated. In some implementations, the electronic device 301 may be a portion of an imaging device. The imaging device may execute operations on or with media, sometimes referred to as print media or a print medium. In some implementations, the imaging device may print, scan, copy, or perform other imaging operations on or with the media. The electronic device 301, in further implementations, may have or may be a printer, plotter, printing press, or another type of imaging device. The electronic device 301 may include a media door 324 which, in FIG. 3A, may be illustrated as being disposed in a closed position. Referring additionally to FIG. 3B, another perspective view of the electronic device 301 is illustrated, wherein the media door 324 is disposed in an open position. In some implementations, the electronic device 301 may include a media compartment to receive the media. In further implementations, the media compartment may receive media disposed on a media roll 326. Media may be a suitable material on which the electronic device may perform imaging operations. In some implementations, the media may include paper, cardboard, card stock, latex, vinyl, or another suitable material. Further, in some implementations, the media may be disposed in a stack within the electronic device 301 instead of disposed on a roll. The electronic device 301, in some implementations, may include a roll support 330. The roll support 330 may be a structural portion of the electronic device 301, in further implementations. The roll support 330 may receive and support a first end of the media roll 326, or a spindle thereof.

The media door 324 may movably enclose the media compartment such that, when the media door 324 is in the closed position, the media from the media roll 326 may be fed from the media roll through the electronic device 301, and/or a print zone or other type of operation zone therein.

Further, when the media door 324 is disposed in the open position, the media compartment may be accessible so as to remove the media roll 326, and/or insert a new media roll 326 into the media compartment. In some implementations, the media door 324 may transition from the closed position to the open position along a direction similar to opening direction 313. In further implementations, the media door 324 may rotate or pivot about an axis of rotation of the media roll in order to transition between the open and closed positions.

In some implementations, the electronic device 301 may include a cam shaft 328 extending along a portion of a length of the media door 324. In further implementations, the cam shaft 328 may extend along the entire length of the media door 324. The electronic device 301 may include an example retainer 300, which may be disposed on the cam shaft 328 or, in other words, along the cam shaft 328. Example retainer 300 may be similar to other example retainers described above. Further, the similarly-named elements of example retainer 300 may be similar in function and/or structure to the elements of such other example retainers, as they are described above. It should be noted that, in combination with other components of the electronic device, the retainer 300 may be referred to as a retainer assembly.

Figure 3C:
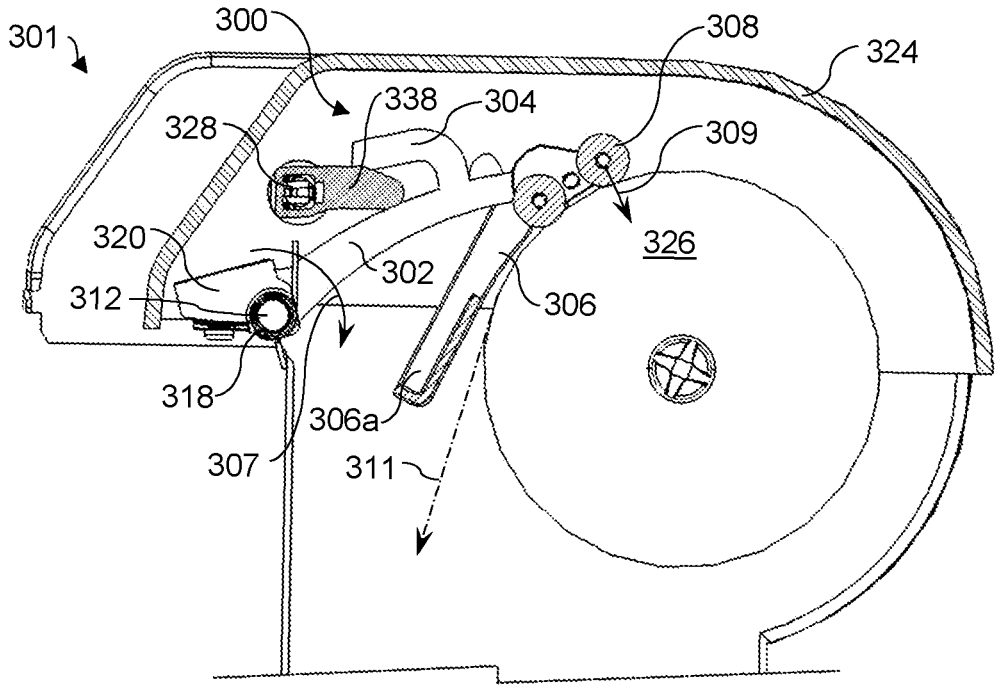
FIG. 3C is a cross-sectional view of an electronic device having an example retainer.

Referring now to FIG. 3C, a cross-sectional view of the electronic device 301 taken along view line 3C-3C of FIG. 3A is illustrated. In FIG. 3C, the media door 324 is illustrated as being disposed in the closed position. The example retainer 300 is illustrated as being disposed in an engaged position. The engaged position refers to a state of the retainer 300 wherein a pinch arm 306, or a pinching member 308 thereof, of the retainer 300 is contacting or pressing against the media disposed on the media roll 326. In other words, the pinch arm 306, or pinching member 308 thereof, may press against the media roll within the electronic device 301 if the pinch arm 306 is disposed in the engaged position. The media from the media roll 326 may be fed through the electronic device 301 in a correctly-aligned and accurate manner when the pinch arm 306, or the pinching member 308 thereof, is pressing against and/or exerting force against the media roll 326 in the engaged position. In some implementations, the pinching member 308 may include a roller or a first and second roller, wherein the contact with the media is made through such rollers.

In the illustrated implementation, the retainer 300 is attached to or assembled on to an interior portion of the media door 324 through a mounting bracket 320. A transition arm 302 and a pinch arm 306 of the retainer 300 may be rotatably engaged with the mounting bracket 320 about a retainer pivot point 312. Additionally, the pinch arm 306 may be pivotably engaged with the transition arm 302 and may be movable between the engaged position and a stowed position through such pivotable engagement. The retainer 300 may include a pivot bias member 318 to urge the retainer 300, or the transition arm 302 and the pinch arm 306 thereof, in a direction about the retainer pivot point 312, similar to direction 307. The pivot bias member 318 may urge the pinch arm 306 towards the media such that the pinching member 308, or the rollers thereof in some implementations, contact and press against the media roll 326. In other words, the pivot bias member 318 may urge the pinch arm 306 towards the engaged position. The pinching member 308 may be disposed on a pinching end of the pinch arm 306 and may press against the media roll 326, resulting in a force vector 309 being exerted against the media, in some implementations. The pinching member 308 may press against the media roll 326 such that the media is fed from the media roll 326 through the electronic device 301 in an accurate and correctly-aligned manner, illustrated in FIG. 3C by example media path 311. Additionally, in some implementations, a guide portion 306*a* of the pinch arm 306 may be structured and oriented relative to the pinching member 308 so as to help guide the media from the media roll 326 along the media path. Thus, the guide portion 306*a* may prevent the media from being fed into an incorrect portion of the electronic device 301 and may prevent the media from jamming or damaging the electronic device 301.

In further implementations, the retainer 300 may further include a lift arm 338. The lift arm 338 may be fixed to the cam shaft 328, in some implementations. In the illustrated implementation of FIG. 3C, the cam shaft 328 is visible in a cross-sectional manner, and thus extends into the viewing plane. The lift arm 338 may be a rigid or semi-rigid member. The transition arm 302, or a lift tab 304 thereof, may be engaged with the lift arm 338. In some implementations, the lift arm 338 may be disposed in a lift cavity in between the lift tab 304 and the transition arm 302. The lift arm 338 may engage with the lift tab 304 such that, if the lift arm 338 were to move towards the lift tab 304, the lift arm 338 may contact and exert a force against the lift tab 304. In the illustrated implementation, the lift arm 338 is shown as being disposed in a first position. The retainer 300 may be disposed in the engaged position when the lift arm 338 is disposed in the first position.

Figure 3D:
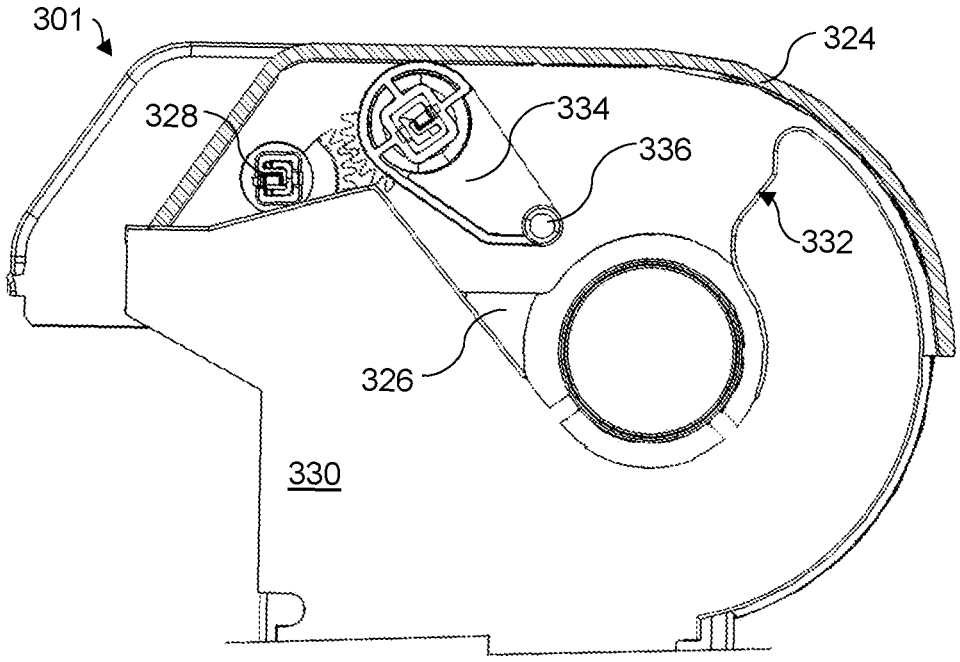
FIG. 3D is a cross-sectional view of an electronic device having an example retainer.

Referring now to FIG. 3D, a cross-sectional view of the electronic device 301 taken along view line 3D-3D of FIG. 3A is illustrated. The media door 324 is still disposed in the closed position in the illustrated implementation of FIG. 3D. The electronic device 301 may include a cam follower 334 disposed at a driven end of the cam shaft 328. The driven end of the cam shaft 328 may refer to an end of the cam shaft 328 that may be disposed near the first end of the media roll 326, and thus near the roll support 330. The cam follower 334 may be rotatable or pivotable relative to the media door 324. Further, the cam follower 334 may be engaged with the cam shaft 328 so as to rotate the cam shaft 328 upon the cam follower 334 being rotated relative to the media door 324. In some implementations, the cam follower 334 is to rotate the cam shaft 328 in an opposite direction than the direction in which the cam follower 334 is being rotated. In some implementations, the electronic device 301 further includes a cam surface 332 to engage with the cam follower 334. In some implementations, the cam surface 332 may be disposed on or may be a unitary portion of the roll support 330 of the electronic device 301. In further implementations, the cam follower 334 may have a cam post 336 extending from the cam follower 334. The cam post 336 may engage with the cam surface 332 upon the cam follower 334 being moved towards the cam surface 332 in some implementations.

Figure 3E:
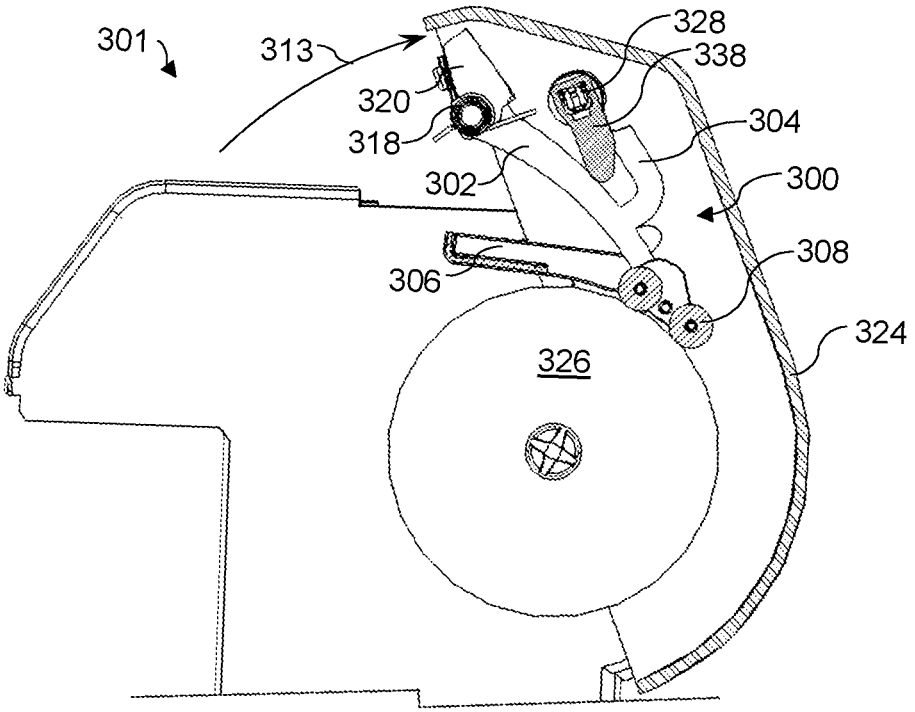
FIG. 3E is a cross-sectional view of an electronic device having an example retainer.
Figure 3F:
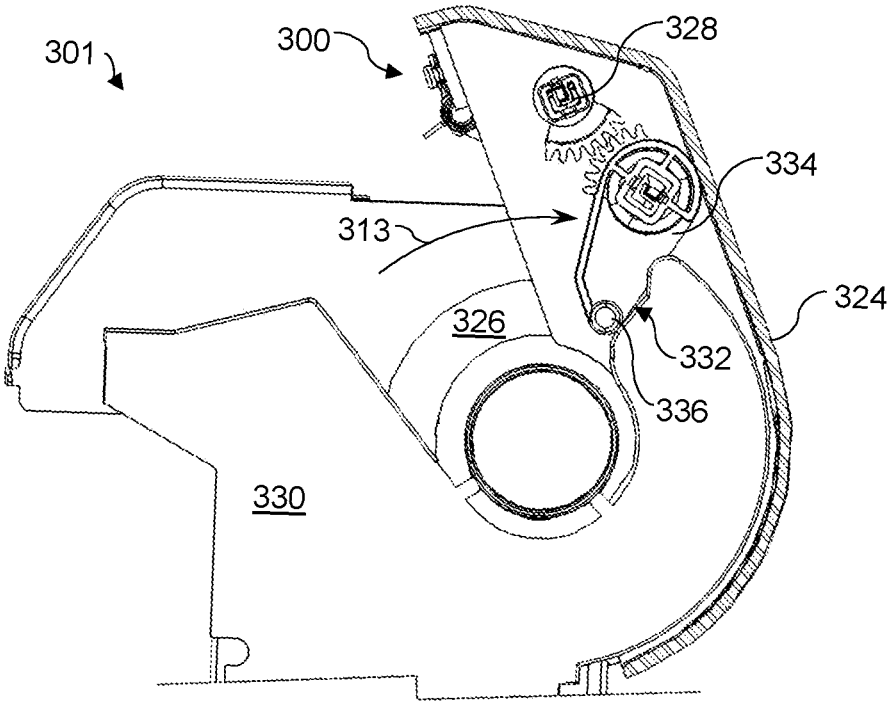
FIG. 3F is a cross-sectional view of an electronic device having an example retainer.

Referring now to FIGS. 3E-3F, cross-sectional views of the electronic device 301 taken along similar view lines as FIGS. 3C-3D, respectively, are illustrated. In the illustrated implementation of FIGS. 3E-3F, the media door 324 has been partially moved or transitioned from the closed position to the open position. The media door 324 may be opened and closed or otherwise moved by a user of the electronic device 301, in some implementations, or by another mechanism in other implementations. The cam follower 334 may be attached to the media door 324 such that the cam follower 334 moves with the media door 324 when the media door 324 is moved, yet still remains rotatable relative to the media door 324. In other words, upon the media door 324 being moved along opening direction 313, the cam follower 334 also may move along a similar opening direction 313, as illustrated in FIG. 3F. The media door 324 has been transitioned from the closed position to a position wherein the cam follower 334, or a cam post 336 thereof, has made initial contact with the cam surface 332, but the cam surface 332 has not caused the cam follower 334 to rotate. In the illustrated state, the retainer 300 may still be contacting and pressing upon the media in a similar fashion as illustrated in FIG. 3C. In other words, the retainer 300 is still disposed in the engaged position, and the lift arm 338 is still disposed in the first position.

Figure 3G:
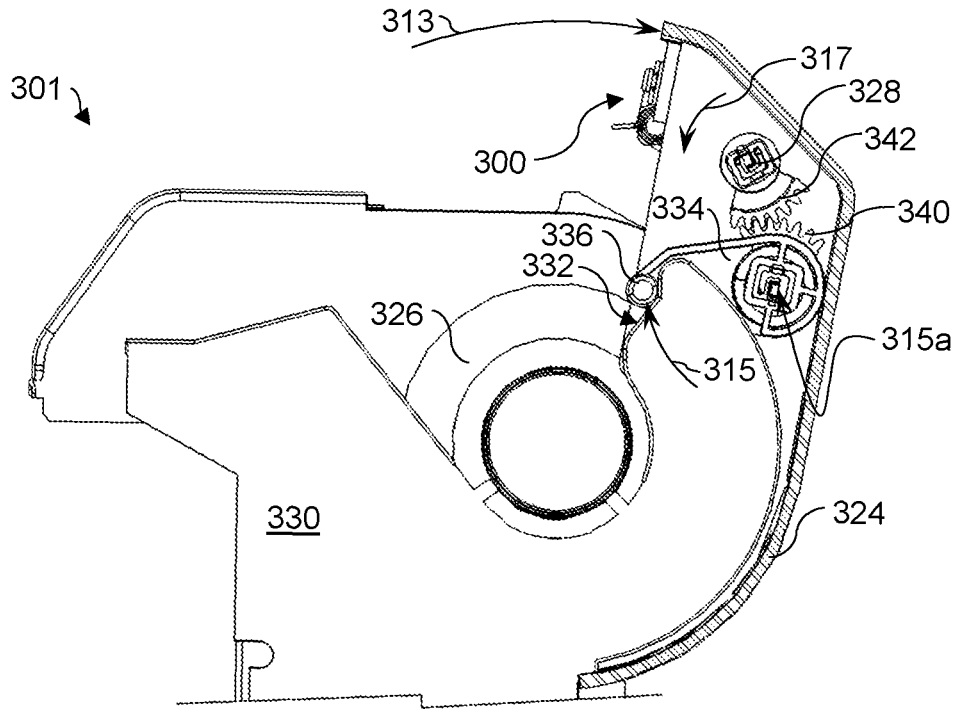
FIG. 3G is a cross-sectional view of an electronic device having an example retainer.

Referring now to FIG. 3G, a cross-sectional view of the electronic device taken along a view line similar to that of FIGS. 3D and 3F is illustrated wherein the media door 324 has been fully transitioned from the closed position to the open position. The open position may refer to a state of the media door 324 wherein the retainer 300, or the pinching member 308 thereof is no longer pressing against the media disposed on the media roll 326 and is spaced away from the media roll 326, thereby enabling the media roll 326 to be removed from the electronic device 301 and providing clearance for a new media roll 326 to be loaded or inserted into the media compartment. In other words, the retainer 300 may be disposed in the stowed position when the media door 324 is disposed in the open position. Further, the media door 324 has been transitioned further along opening direction 313. Accordingly, cam follower 334 has been moved with the media door 324 along opening direction 313. Since the cam follower 334, or the cam post 336 thereof, was previously in contact with the cam surface 332, as illustrated in FIG. 3F, further movement of the cam follower 334 along opening direction 313 may cause the cam post 336 to move along the cam surface 332. Such movement of the cam post 336 along the cam surface 332 may cause the cam follower 334 to rotate relative to the media door 324 along cam pivot direction 315 about cam pivot point 315*a*. Such rotation of the cam follower 334 may, in turn, rotate the cam shaft 328 as the cam follower 334, or the cam post 336 thereof, is moved along the cam surface 332. The cam follower 334 may cause the cam shaft 328 to rotate through the engagement of the cam follower 334 with the cam shaft 328. One implementation of such an engagement between the cam shaft 328 and the cam follower 334 is described further below, but other manners of engaging the cam shaft 328 and the cam follower 334 are also contemplated and considered within the scope of the present disclosure.

In some implementations, the cam follower 334 may include a driving member 340 fixed to the cam follower 334 to engage with a driven member 342 of the cam shaft 328. The driven member 342 may be fixed to the cam shaft 328, or, in some implementations, may be fixed to the cam shaft 328 at the driven end of the cam shaft 328 such that the driven member 342 may engage with the driving member 340 of the cam follower 334. In some implementations, the driven member 342 may include a tooth array to engage with a complementary tooth array of the driving member 340. Thus, the driving member 340 and the driven member 342 may engage with each other in a cog or gear-like fashion such that rotation of the driving member 340 may be transferred to the driven member 342 so as to cause the driven member 342 to rotate in a corresponding manner. In other implementations, the driving member 340 and the driven member 342 may engage with each other through friction surfaces or another method to enable the transfer of motion from one to the other. The rotation of the cam follower 334, and thus the driving member 340, along the cam pivot direction 315 may cause the driven member 342, and thus the cam shaft 328, to rotate in a corresponding stowing direction 317. Stated differently, the driving member 340 may move the driven member 342 to rotate the cam shaft 328 in the stowing direction 317. In some implementations, the stowing direction 317 may be an opposite direction than the cam pivot direction 315.

Figure 3H:
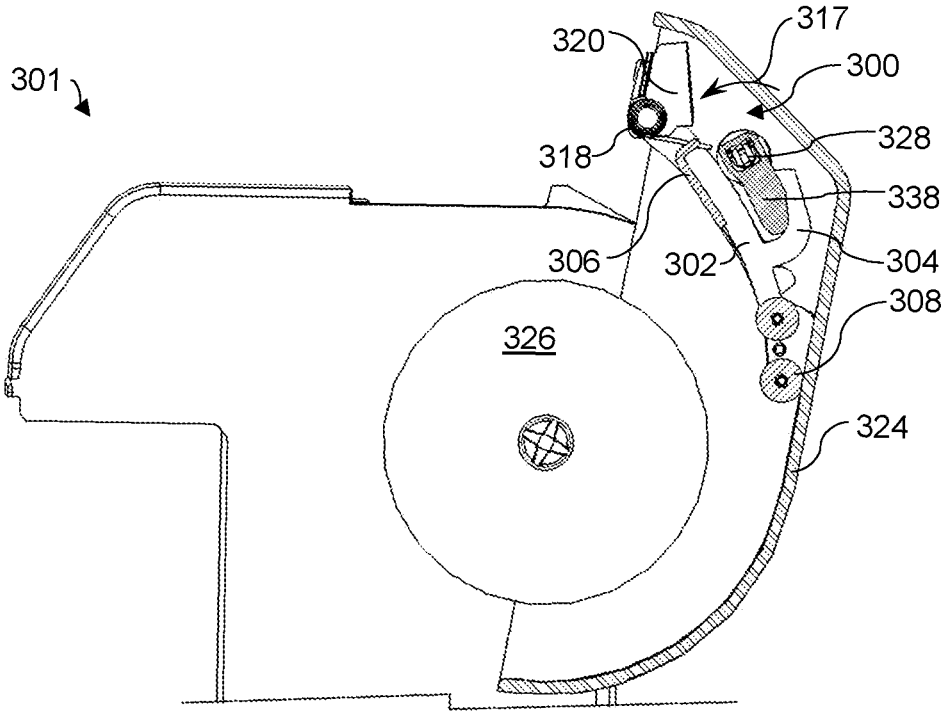
FIG. 3H is a cross-sectional view of an electronic device having an example retainer.

Referring now to FIG. 3H, a cross-sectional view of the electronic device taken along a view line similar to that of FIGS. 3C and 3E is illustrated wherein the media door 324 has been fully transitioned from the closed position to the open position. Due to the fixed engagement between the lift arm 338 and the cam shaft 328, the rotation of the cam shaft 328 along the stowing direction 317 may cause the lift arm 338 to also rotate along the stowing direction 317 from the first position to a second position. In other words, upon the media door 324 being transitioned to the fully open position, the lift arm 338 may move along the stowing direction 317 to the second position. The lift arm 338 may push, pull, or otherwise cause the lift tab 304 and the transition arm 302, along with the pinch arm 306, to transition or move from the engaged position to a stowed position, against the urging of the pivot bias member 318. Thus, the cam shaft 328 may move the pinch arm 306 from the engaged position to the stowed position. The retainer 300 is illustrated as being disposed in the stowed position in FIG. 3H. When disposed in the stowed position, the retainer 300, and the pinch arm 306 thereof, may be spaced apart from the media of the media roll 326. Therefore, upon the media door 324 being moved from the closed position to the open position, the retainer 300 is moved from the engaged position to the stowed position. Stated differently, the transition arm 302 may move the pinch arm 306 from the engaged position to the stowed position upon the lift arm 338 moving in the stowing direction 317 from the first position to the second position.

The retainer 300 may be transitioned from the stowed position back to the engaged position upon the media door 324 being moved from the open position back to the closed position. As the media door 324 is being moved from the open position to the closed position, the cam follower 334 may again move with the media door 324. The urging of the pivot bias member 318 on the transition arm 302 may be transferred into a corresponding force exerted by the lift tab 304 upon the lift arm 338 in a pinching direction, opposite to the stowing direction. Such force exerted on the lift arm 338 may be transferred through the cam shaft 328, causing the cam shaft 328 to want to rotate in the pinching direction, and through the engagement of the driven member 342 with the driving member 340. Thus, the reactive force exerted by the pivot bias member 318 may continually urge the cam follower 334 in a direction opposite to the cam pivot direction 315. Therefore, upon the media door 324 moving from the open position to the closed position, the reactive force of the pivot bias member 318 may cause the cam follower 334, or the cam post 336 thereof, to follow the cam surface 332 and thereby allow the cam follower 334 to rotate in a direction opposite to the cam pivot direction 315. Such opposite rotation of the cam follower 334 may result in the lift arm 338 allowing the lift tab 304 to lower, and thus the transition arm 302 and the pinch arm 306 also lowering until the retainer 300 reaches the engaged position contacting the media of the media roll 326. Stated differently, the transition arm 302, under the urging of the pivot bias member 318, may move the pinch arm 306 from the stowed position, spaced away from the media roll 326, to the engaged position upon the lift arm 338 being allowed to pivot from the second position to the first position.

Figure 4:
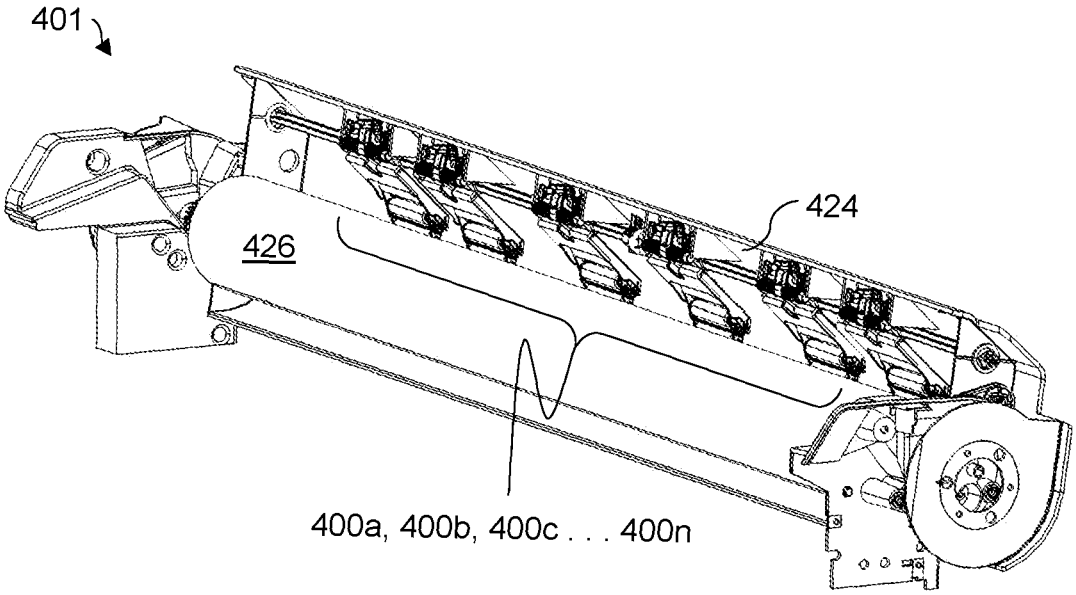
FIG. 4 is a perspective view of an electronic device having an example retainer.

Referring now to FIG. 4, a perspective view of an electronic device 401 is illustrated. In some implementations, the electronic device 401 may include a plurality of example retainers 400*n*. Example retainers 400*n* may be similar to other example retainers described above. Further, the similarly-named elements of example retainers 400*n* may be similar in function and/or structure to the elements of such other example retainers, as they are described above. The example retainers 400*n* may be attached to a media door 424 and disposed along a cam shaft of the electronic device 401, and may be movable between an engaged position, pressing against a media roll 426, and a stowed position, spaced away from the media roll 426.

What is claimed is:

1. A retainer, comprising:

a transition arm having a lift tab; and a pinch arm pivotably engaged with the transition arm, the pinch arm movable between an engaged position and a stowed position and having a pinching member disposed on a pinching end of the pinch arm, wherein the transition arm is to move the pinch arm from the engaged position to the stowed position upon the lift tab being moved about a retainer pivot point.

2. The retainer of claim 1, further comprising a lift arm engaged with the lift tab, wherein the transition arm is to move the pinch arm from the engaged position to the stowed position upon the lift arm moving from a first position to a second position.

3. The retainer of claim 2, wherein the transition arm is to move the pinch arm from the stowed position to the engaged position upon the lift arm being pivoted from the second position to the first position.

4. The retainer of claim 3, wherein the lift arm is pivoted from the first position to the second position by a cam shaft.

5. The retainer of claim 1, wherein the pinching member is a roller rotatable relative to the pinch arm.

6. The retainer of claim 5, wherein the pinching member comprises a second roller disposed at the pinching end of the pinch arm, wherein the first and second roller are to rotate relative to each other and the pinch arm.

7. A retainer assembly, comprising:

a cam shaft;

a driven member fixed to the cam shaft; and a retainer, comprising:

a lift arm fixed to the cam shaft;

a transition arm engaged with the lift arm; and a pinch arm pivotably engaged with the transition arm and movable between an engaged position and a stowed position;

wherein the driven member is to rotate the cam shaft in a stowing direction to move the lift arm from a first position to a second position, and the cam shaft is to rotate in a pinching direction to move the lift arm from the second position to the first position, and wherein the transition arm is to move the pinch arm from the engaged position to the stowed position upon the driven member rotating the cam shaft in the stowing direction, and the transition arm is to move the pinch arm from the stowed position to the engaged position upon the cam shaft rotating in the pinching direction.

8. The retainer assembly of claim 7, wherein the driven member is engaged with a driving member of a cam follower, the driving member to move the driven member to rotate the cam shaft.

9. The retainer assembly of claim 8, wherein the driven member includes a tooth array to engage with a complementary tooth array of the driving member.

10. The retainer assembly of claim 7, wherein the retainer further includes a pivot bias member to urge the pinch arm towards the engaged position.

11. An imaging device, comprising:

a printer;

a media door enclosing a media compartment;

a cam shaft extending along a portion of a length of the media door;

a retainer disposed on the cam shaft, comprising:

a lift arm fixed to the cam shaft;

a transition arm engaged with the lift arm; and a pinch arm engaged with the transition arm and including a roller disposed on a pinching end of the pinch arm;

a cam follower disposed at a driven end of the cam shaft; and a cam surface to engage with the cam follower, wherein the cam follower is to rotate the cam shaft as the cam follower is moved along the cam surface, the cam shaft to move the pinch arm from an engaged position to a stowed position.

12. The imaging device of claim 11, wherein the pinch arm is to press against a media roll within the imaging device if the pinch arm is disposed in the engaged position, and the pinch arm is to be spaced apart from the media roll if disposed in the stowed position.

13. The imaging device of claim 12, wherein the cam follower is to be moved along the cam surface by the media door upon the media door being moved from a closed position to an open position.

14. The imaging device of claim 11, wherein the cam surface is disposed on a roll support of the imaging device, the roll support to support a first end of a roll of media within the imaging device.

15. The imaging device of claim 11, further comprising a plurality of retainers disposed along the cam shaft.

* * * * *